US007677413B2

(12) United States Patent
Rahim et al.

(10) Patent No.: US 7,677,413 B2
(45) Date of Patent: Mar. 16, 2010

(54) PIERCEABLE DISPENSER CONTAINER AND CLOSURE

(75) Inventors: Usman Rahim, Edison, NJ (US); Dennis A. Gross, Lake Forest, IL (US)

(73) Assignee: Barnsto, Ltd., Northbrook, IL (US)

( * ) Notice: Subject to any disclaimer, the term of this patent is extended or adjusted under 35 U.S.C. 154(b) by 293 days.

(21) Appl. No.: 11/454,586

(22) Filed: Jun. 16, 2006

(65) Prior Publication Data

US 2007/0272704 A1 Nov. 29, 2007

Related U.S. Application Data

(63) Continuation-in-part of application No. 11/439,582, filed on May 24, 2006, now abandoned.

(51) Int. Cl.
*B67D 5/00* (2006.01)

(52) U.S. Cl. ..... 222/83; 222/91

(58) Field of Classification Search ..... 222/81, 222/83, 89, 91, 5, 83.5, 88; 401/134, 135; 221/31, 30; 604/411, 415; 141/329, 330; 220/277, 278; 215/247–249
See application file for complete search history.

(56) References Cited

U.S. PATENT DOCUMENTS

| | | | | |
|---|---|---|---|---|
| 2,805,725 | A * | 9/1957 | Bagarozy | 169/77 |
| 3,378,168 | A * | 4/1968 | Hildebrandt | 222/83 |
| 4,723,687 | A * | 2/1988 | Kutterer | 222/83 |
| 5,649,648 | A | 7/1997 | Lier et al. | |
| 5,799,829 | A | 9/1998 | Lier et al. | |
| 6,726,060 | B1 | 4/2004 | Ragusa et al. | |

FOREIGN PATENT DOCUMENTS

| | | | | |
|---|---|---|---|---|
| EP | 0223717 | * | 5/1987 | 222/81 |

* cited by examiner

*Primary Examiner*—J. Casimer Jacyna
(74) *Attorney, Agent, or Firm*—The Hill Firm; Dennis A. Gross

(57) ABSTRACT

A dispensing container having a neck with a throat opening closed by a cap having a pierceable membrane adjacent atop of the cap, the cap having a dispensing nozzle with a lumen therethrough and an overcap for enclosing the dispensing nozzle having a moveable plunger pin extending into the lumen of the nozzle and moveable therein to pierce the membrane.

11 Claims, 2 Drawing Sheets

12
74
71
72
70
60
61
15
19
44
53
47a
47
51
21
48
43
49
50
42
45
30
27
44
26
25
40
46
23
20
16
18
19
21
16
15
14
13
11
10
12

PIERCEABLE DISPENSER CONTAINER AND CLOSURE

This application is a continuation-in part of U.S. patent application Ser. No. 11/439,582 filed May 24, 2006.

FIELD OF THE INVENTION

This invention relates to containers and more particularly to a dispensing container having a neck portion with a throat opening closed by a cap having a pierceable membrane adjacent atop thereof, a nozzle defining cap secured to the cap having a dispensing nozzle with a lumen therethrough projecting away from the cap, an overcap received over the dispensing nozzle, the overcap carrying a moveable plunger pin for piercing the membrane.

BACKGROUND

Product dispensers consisting of containers closed by a pierceable membrane are well known and are commonly employed, for example, in adhesive containers where the sealing of the container by the membrane at one end of the container protects the contents against the adverse consequences of exposure to the environment during shipment and storage. It has been known to provide such containers with dispensing nozzles extending from the membrane area which carry overcaps having moveable plungers or pins that project through the lumen of the nozzle and which can be activated to pierce the membrane. Upon piercing the membrane and removal of the overcap, the contents of the container can be dispensed through the nozzle to a desired location. Upon recapping the nozzle with the overcap with the pin in its piercing position, the pin will reenter the pierced opening in the membrane to partially or substantially reseal the container.

Such moveable pin membrane piercing containers are shown, for example, in U.S. Pat. Nos. 6,726,060 and 5,799,829. Such known containers are formed as metal tubes having an open end opposite the membrane-closed end. The open end is used for filling the container and it may then be closed by a securely fastened plug. While such containers are particularly applicable for use with cyanoacrylates, they are not preferred for other adhesives, such as anaerobics, particularly where chemical interaction may occur with a metal container. In such instances a plastic container may be preferred.

Since plastic containers are often formed by a blow molding process, it is necessary to mold the container with an opening, however for a number of reasons, including the difficulties associated with properly securing a closure plug, such containers are most frequently blow molded from the end of the container forming the dispense opening.

A common form of such a container may, for example, employ a projecting neck which defines a throat opening which may also be used to fill the container and which may thereafter be closed by a cap or, in some instances, by a combination of a sealing foil and cap. The use of peelable sealing foils adhesively or otherwise secured at the neck end closing the throat opening is also a well known way of protecting the contents, after filling, from environmental degradation. Such foils may be constructed of various materials and may be cut, stripped, peeled or pierced to gain access to the contents of the container.

Where it is desired to provide such a container with a foil that is to be pierced to provide an opening, it is generally preferred to form such foils of materials that are relatively susceptible to piercing, such as paper, thin metal foils or the like. Because most plastics have a relatively high degree of elasticity, they are generally not suitable for closure foils where it is intended that the foil be pierced. Such plastics have a tendency to stretch, dimple and then tear when subjected to a piercing operation and would therefore be contraindicated for a pierceable container closure, even though a plastic material closure may have other advantages depending on the contents of the container.

A further disadvantage arises with the use of foil-like closures at the throat opening. Because such closures must be affixed to the open end of the neck, particularly where a cap is to be placed over the neck, the available surface for attachment is limited to the annulus formed at the neck top, which annulus defines the throat opening. Not only does this limit the security of the attachment of the sealing foil to the container, it adversely interferes with obtaining a good seal at the throat when the initial cap structure carried at the throat is a dispensing nozzle, having a lumen opening through it. Where the dispensing nozzle cap is to be attachable to the container prior to removal or piercing of the foil, the dispensing nozzle cannot be provided with any portion thereof projecting into the throat opening as that would interfere with the closure foil. Upon removal or piercing of the closure foil, then the seal formed between the dispensing nozzle cap and the container is limited to the annulus area which can provide a leakage path to the outside surface of the neck.

While the structure disclosed in U.S. Pat. No. 6,726,060 avoids the leakage path problem at the intersection of the throat opening and the dispensing nozzle cap, it does so by positioning the closure membrane axially spaced from the throat opening and providing a frustoconical extension on the undersurface of the nozzle cap which extension extends into the throat opening as a plug and which provides an edge seal at the i.d. of the open end of the throat. Such a seal cannot be provided in connection with a throat covering foil seal.

It would therefore be an advance in the art to provide a dispensing container and cap assembly having a pierceable membrane sealing a throat opening of the container, where the container is initially formed with an open throat and where the membrane is positioned to allow an edge seal to be created at the i.d. at the open end of the throat. It would be a further advance in the art to provide a plastics material membrane in such an assembly.

SUMMARY OF THE INVENTION

This invention overcomes disadvantages of the prior art by providing an intermediate cap which closes the throat opening of the container and which defines a dispensing channel extending from the throat opening to a membrane formed intermediate the ends of the intermediate cap with the intermediate cap having a first proximal end engageable and securable to the container and having a first end interior boss extending into the throat opening of the container and a distal end opposite the container engaging end adaptable to receive a nozzle cap wherein the distal end has a recess terminating at a bottom in a membrane closing a discharge channel through the intermediate cap.

In an embodiment of the invention the intermediate cap at the proximal end is internally threaded to mate with threads formed on an exterior of the neck of the container and the distal end portion is formed with exterior threads to mate with interior threads at a proximal end of a nozzle cap.

In an embodiment of the invention the intermediate cap is formed of molded plastic and the membrane is molded in situ intermediate the distal and proximal ends of the intermediate cap spaced closer to the distal end.

In a further embodiment of the invention, the container is formed with a projecting neck having external threads with a throat opening at the top of the neck, an intermediate cap is provided having a proximal end forming a circumferential skirt defining a hollow end opening having internal threads to mate with the external threads of the neck of the container, the intermediate cap having a projecting boss at a bottom wall of the threaded opening which is dimensioned to extend into the throat opening of the container in sealing engagement with I.D. portions of the throat opening, the intermediate cap having a distal end portion having an axial extent with external threads having a diameter less than the diameter of the proximal end and adapted to engage with internal threads of a skirt portion of a proximal end of a nozzle cap, the distal end face of the intermediate cap having a recess therein for receipt of a boss portion of the nozzle cap with the boss portion sealingly engaging interior surface portions of the recess, the intermediate cap having a dispensing channel extending from the boss of the intermediate cap to a membrane formed as a bottom of the recess, the nozzle cap having a lumen open to the end of the boss of the intermediate cap and to a tip of the nozzle cap, the boss of the nozzle cap projecting into the recess in the intermediate cap to a distance short of the membrane, an overcap having a channel therethrough receiving a plunger pin, the plunger pin having a pin body extending into the lumen of the nozzle cap when the overcap is in full seated position on the nozzle cap, the pin being moveable from a position where a piercing end thread is spaced from the membrane to a position where the piercing end projects through the membrane.

In an embodiment of the invention, the membrane in the intermediate cap is thicker at its outer periphery than at its center and the plastics material of the intermediate cap and membrane is elastic whereby the piercing end of the pin first stretches then pierces through the material of the membrane such that the material of the membrane constricts into engagement with the pin O.D. after piercing.

It is therefore an object of this invention to provide a plastics material closure for a container including an intermediate cap engageable with the neck of a container to secure the intermediate cap to the container, the intermediate cap having a dispensing channel terminating in a membrane, the intermediate cap having a distal end with a recess therein bottoming at the membrane, a nozzle cap having a lumen therethrough secured to the intermediate cap with the lumen open to the recess adjacent the membrane and an overcap adapted to be carried by the nozzle cap, the overcap having a moveable piercing pin extending into the lumen and moveable between a first position spaced from the membrane and a second position piercing the membrane.

It is a further object of this invention to provide a container and closure therefore consisting of a molded plastics container having a threaded projecting neck terminating in a throat opening, an intermediate cap threadably engageable with the neck having a sealing surface for sealingly engaging with the neck at the throat opening, the intermediate cap having a dispenser channel aligned with the throat opening, the dispensing channel terminating in situ formed plastics membrane, the intermediate cap having a distal end with a depression therein bottoming at the membrane whereby the membrane is positioned intermediate the ends of the intermediate cap, a nozzle cap threadably engaging the distal end of the intermediate cap having an interior surface extending into the depression sealingly engaging the distal end of the intermediate cap and the nozzle cap having a lumen therethrough receiving a piercing pin carried by an overcap threadably engageable with the nozzle cap, the pin being moveable between a first position spaced from the membrane and a second position piercing the membrane, and wherein the membrane has a thickness in a central area thereof facilitating piercing of the membrane by a piercing end of the pin while having a modulus of elasticity such that the opening formed by piercing of the membrane by the pin has a free state dimension less than the cross section dimension of the largest portion of the pin to have passed into the membrane.

These and other objects of the invention will be apparent to those skilled in the art from a description of a preferred embodiment of the invention which follows, it being understood that persons skilled in this art will have knowledge to practice the invention in forms, dimensions and materials different than those described in the preferred embodiment.

DESCRIPTION OF THE PREFERRED EMBODIMENT

Figures 1, 2, 3:
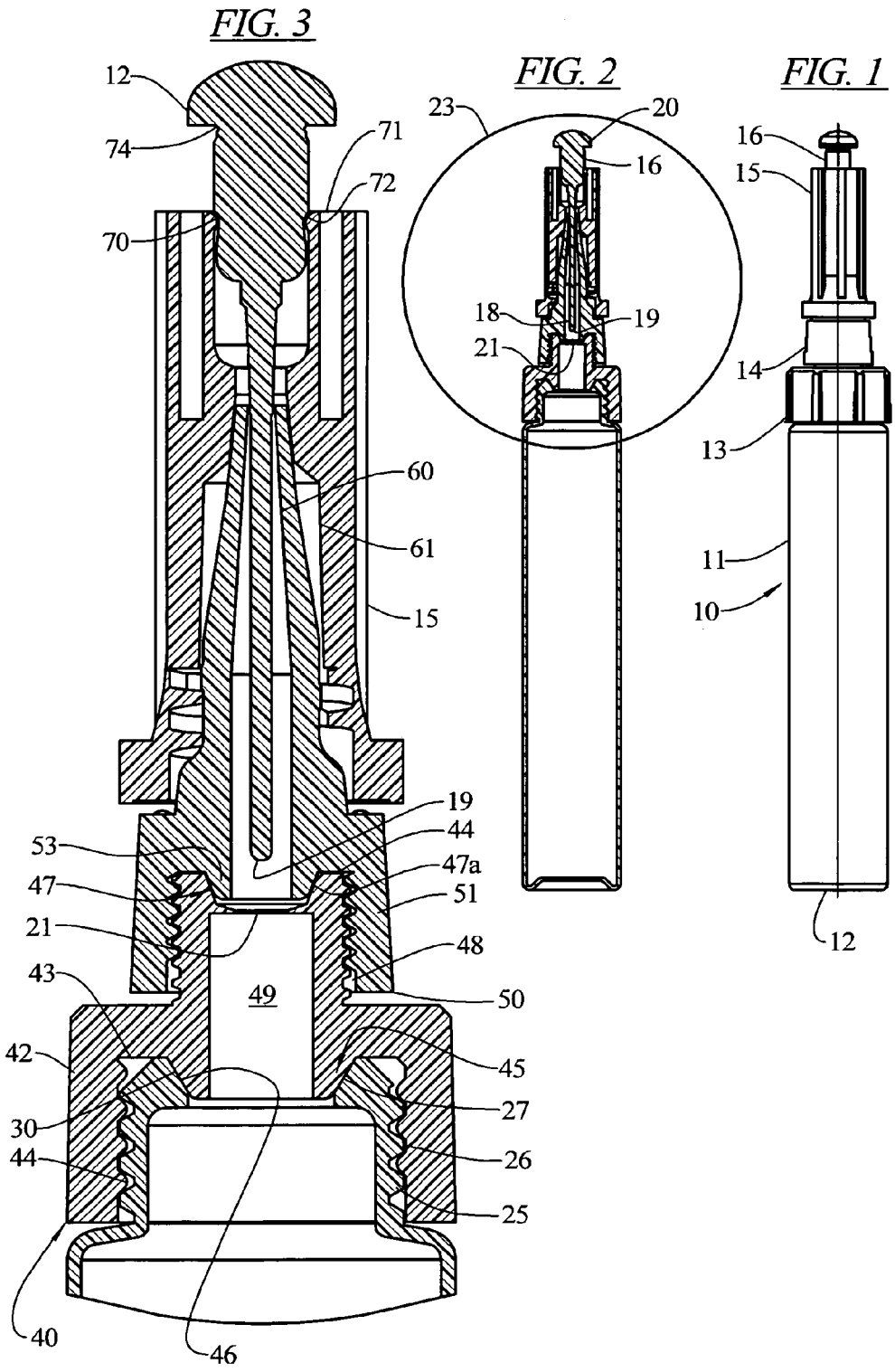
FIG. 1 is an exterior view of a dispensing container and cap assembly.
FIG. 2 is a cross sectional view of FIG. 1 illustrating the container, an intermediate cap, a nozzle cap, and an overcap.
FIG. 3 is an enlarged cross sectional view of the end of the container and the cap assembly.

As shown in FIG. 1, a dispensing container and cap assembly 10 is provided having a container body 11 which has a closed bottom 12 at one end and which carries an intermediate cap 13 at the other end. A nozzle cap 14 is carried by the intermediate cap and projects away from the container body 11. An overcap 15 is carriable by the nozzle cap and in turn carries a moveable plunger pin 16. The nozzle cap, overcap and plunger pin are preferably constructed similar to the teachings of U.S. Pat. No. 6,726,060, the teachings of which are incorporated herein by reference.

The container body is preferably a blow molded body 11 and although shown as being substantially tubular in the preferred embodiment, it would be understood by persons of ordinary skill in the art that the container body 11 may be otherwise shaped and may be formed by methods other than blow molding and could, for example, if compatible with the contents, be formed of metal or other non-plastic material. In the preferred embodiment, the intermediate cap is a plastics material structure formed of polyethylene, hydensilypolyethylene, polyprophylene or high impact polyprophylene, HIPP. These materials can be compatible with, for example, anaerobic adhesives. Similar plastics materials may be used for the container body 11, the nozzle cap 14 and the overcap 15. Preferably the pin 16 is formed either by molding or machining of reinforced plastics material, for example fiberglass-filled or carbon fiber containing plastics. Although the pin 16 is preferably formed as a unitary piece, it would be appreciated by those skilled in the art that at least the non-head portion 18 including the piercing tip 19 may be formed separately from the pin head 20 and affixed thereto by various methods including insert molding. Depending upon the material of the membrane 21 positioned in the intermediate cap 13, portions of the pin 16, including at least the tip 19, may be strengthened with respect to other portions of the tip 16 or formed of a different material, such as metal, at least in part.

As best shown in FIG. 3, the container is formed with a neck 25 having an exterior thread 26, the neck terminating in a throat opening 27. The throat opening may have an inner diameter less than the inner diameter of the neck portion 25 and may be formed as a circular opening having an angled or frustoconical inner diameter defining wall 30. The intermediate cap 14 is provided with a proximal end 40, a distal end 41 and a body portion between the ends. A skirt portion 42 defines the proximal end and is internally threaded and terminates in a bottom wall 43 such that the skirt portion forms a central recess or bore in the body of the intermediate cap open to the proximal end. The skirt portion is internally threaded at 44 with thread designed to mate with the thread 26 of the container neck.

Preferably the threads 26 and 44 are of the type known as self-locking threads such that upon fully tightening the intermediate cap onto the neck of the container, a high resistance to unthreading is created, and any leakage path through the thread is minimized or eliminated. The bottom wall 43 of the intermediate cap is provided with a central boss 45 projecting into the bore. The boss preferably has an outer diameter surface 46 defined by a slanted or frustoconical wall dimensioned to extend into the throat opening and to engage the wall 27 of the throat opening in a sealing manner. Where the wall 27 is formed as a slanting or frustoconical wall, the wall 46 may have a mating taper or a slightly different taper providing a slight interference bit between the container throat opening wall 27 and the intermediate cap boss wall 46. Alternatively, the wall 27 of the container may be cylindrical providing an inner diameter top edge which will engage the sloping wall 46 of the boss 45 in an edge seal. Again, a slight interference bit may be advantageous when the intermediate cap is fully threaded onto the container neck.

The distal end 41 of the intermediate cap is provided with a central recess or depression 47 which may be defined by an inner diameter boundary wall having sealing and shape characteristics similar to that described for the throat opening of the neck. The nozzle cap 14 may preferably have a proximal end 50 defined by a threaded skirt 51 having internal threads terminating in a bottom wall 52 interior of the skirt, the bottom wall having a raised boss 53 centrally located therein. The boss 53 may have an exterior wall similar to the wall 46 of the intermediate cap such that the nozzle cap, when threaded onto exterior thread 48 of the intermediate cap will sealingly engage between the boss 53 and the recess wall 47 in a manner similar to that described above between the container throat opening and the boss 45 of the intermediate cap. The recess 47 terminates at its bottom in the membrane 21, the other side of the membrane forming a proximal end or dividing wall of a dispensing channel 49. The dispensing channel 49 is open to the central portion of the boss 45 and extends from the throat opening to the membrane when the intermediate cap is secured to the container. Upon piercing of the membrane the dispensing channel 49 will be open to the recess 47 forming a full dispensing channel through the intermediate cap.

Again, it is preferable if the thread securing the nozzle cap to the intermediate cap be formed so as to provide a secure attachment of the nozzle cap to the intermediate cap resisting unthreading. Such thread designs which are known to persons skilled in the art, in addition to securely affixing the intermediate cap to the container and the nozzle cap to the intermediate cap additionally form barriers to leakage paths along respectively the inner section of the inner diameter of the skirt of the intermediate cap and the outer diameter of the neck of the container and the inner diameter of the skirt of the nozzle cap and the outer diameter of the intermediate cap.

As illustrated in FIGS. 2 and 3, the intermediate cap may be stepped such that the distal end is of smaller diameter than the proximal end with the externally threaded area of the distal end being of sufficiently smaller diameter such that the outer diameter of the skirt of the nozzle cap does not extend beyond the outer diameter of the skirt portion of the intermediate cap.

Figure 4:
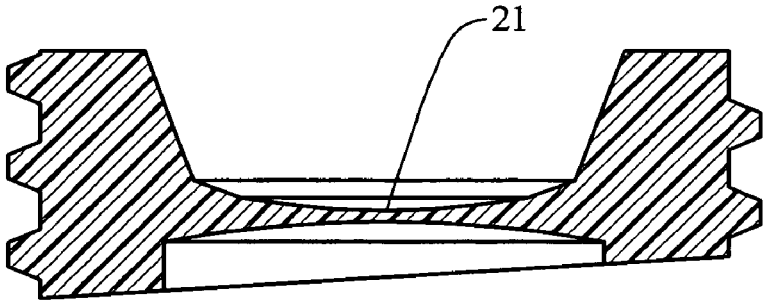
FIGS. 4, 5 and 6 are cross sectional views of different embodiments of the diaphragm of the intermediate cap.
Figure 5:
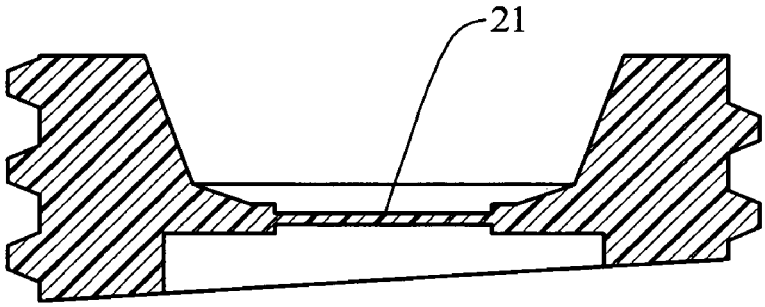
Figure 6:
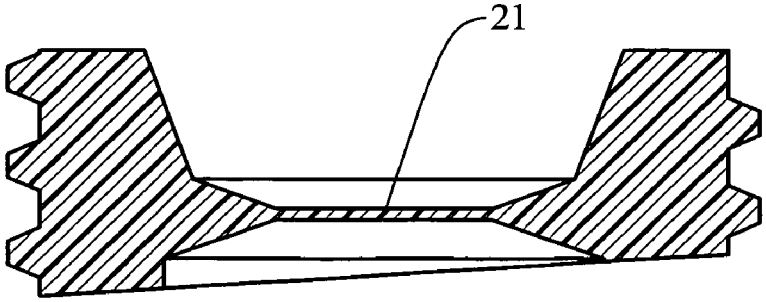

In the preferred embodiment the membrane 21 is formed in situ during the modeling of the intermediate cap is monolithic therewith and as shown in FIGS. 4, 5 and 6, is dimensioned to be thinner in its central area than at its outer periphery where it merges into the main body portion of the intermediate cap. This thinning may be formed by opposed convex and concave surfaces as shown in FIG. 4 or by a thicker ring at the outer periphery of the membrane as shown in FIG. 5 or, preferably, by a tapered transition ring as shown in FIG. 6 where the outer periphery tapers at, at least on one end side, and preferably both end sides, of the membrane and the central section is relatively thin.

As is known to those skilled in the art of plastics, plastics materials have a normal elasticity to a greater or lesser extent. Such elasticity makes such plastics materials difficult to pierce since the plastics will initially stretch forming a dimple in the membrane when the pin tip is forced against the membrane.

That dimple will subsequently begin to rupture or tear allowing the pin tip to pass through the membrane. It has been found that, however, the opening formed by the tearing of a slightly elastic plastics material membrane, although initially being large enough for the pin to pass through the membrane, given proper selection of plastic material grippingly engage the outer diameter of the pin. Upon removal of the pin the opening of the membrane may be noticed to be smaller overall than the cross-sectional volume of the portions of the pin which pierced through the membrane. Additionally, it has been discovered that the dimple formed at the initial stage of piercing will, to an extent, be retained in the subsequent free state of the membrane after the pin has been withdrawn.

The pin is axially moveable in the overcap between a first position, illustrated in FIG. 3, where the tip 14 is spaced from the membrane 21 to a pierced position where the tip 14 has passed through the membrane and into the dispensing channel 49. The pin extends through the lumen 18 of the nozzle cap. When the overcap is rethreaded onto the nozzle cap, with the pin in the fully depressed piercing position, the pin tip will again enter the opening through the membrane. The dimple helps to align the tip end by forming a guiding depression. In this manner it has been determined that the pin, in the normal course, will reenter the opening in the membrane, where due to the elasticity of the membrane, the boundary walls of the opening will engage the outer diameter of the pin aiding in providing a good seal between the interior of the container body and the environment.

A secondary seal is provided along the length of the pin by providing a tapered wall 60 intermediate the ends of a central channel 61 which extends through the overcap. The tapered wall 60 sealingly engages the outer diameter of the tip area 55 of the nozzle tip and may act to constrict the tip area into contact with the outer diameter of the pin upon full seating of the overcap on the nozzle cap. The pin may have a larger diameter in the area which enters the tip end when the pin is in its piercing position.

To retain the piercing pin in its full up, non-piercing position, the pin may be provided with an indentation or circumferential groove 70 at the head 20 and the channel 61, adjacent its distal end 71 may be provided with an inner diameter bead 72 which is snapable into the groove 70 thereby providing an initial resistance to movement of the pin. A secondary groove 74 may be provided axially spaced from the groove 70 into which the bead 72 will extend when the pin is in its fully depressed, membrane piercing position. The bead may be discontinuous.

The overcap 15 is threadably received on the nozzle cap, preferably through a non-locking thread engagement allowing relatively easy connection of the overcap to the nozzle cap and removal therefrom. Since upon re-affixing the overcap to the nozzle cap, the pin will project through the lumen, a post piercing sealed condition exists. That condition includes the sealing face engagement between the throat opening 27 and the boss 45, the seal formed by the boss 53 and the recess 47, the seal formed by the pin extending into the opening in the membrane and a seal formed by the engagement of the dispensing nozzle tip with the outer diameter of the pin. The sealing interfaces combine with the sealing nature of the thread connection between the dispensing cap and the intermediate cap and the sealing thread connection between the intermediate cap and the container neck. Persons of skill in the art will appreciate that the bass and mating surface portions could be reversed so that, for example, the recess could be formed on the nozzle cap and the boss on the intermediate cap. In such an arrangement the membrane could be positioned at or adjacent the boss end. It will be appreciated that these multiple sealing points, individually and collectively, both protect the contents of the container from environmental degradation after opening of the membrane and prevent leakage irrespective of the orientation of the container during those periods between dispensing usage. In this manner, not only does the membrane sealed container provide an extended shelf life for the filled container prior to piercing, it extends the shelf life of the contents subsequent to piercing.

Although we have shown a preferred embodiment in which the container, the intermediate cap, the nozzle cap, the overcap, and the piercing pin may all be formed of plastics material, and the membrane formed in situ during molding of the intermediate cap, it will be appreciated that other variations may be provided and that one or more of the component parts or assemblies may be manufactured of other materials. For example, the membrane may be formed as a separate diaphragm and secured in place in the dispensing channel of the intermediate cap by various techniques, including insert molding, thermal bonding or as a part of a threaded or otherwise secured plug member. Additionally, although the preferred embodiment is particularly suitable for anaerobic adhesives, it will be understood that by proper selection of the materials of the various component parts, either alone or in combination with known filling techniques, such as filling in the presence of an inert gas, the dispensing container of this invention may be used with other materials, including other adhesives, fluidic solder, pastes, epoxies, solvents, or in general, those materials benefiting from containers protected against environmental contamination while providing enhanced control over dispensing. In the embodiment illustrated, the container body is preferably yieldable and resilient so that dispensing is easily controlled by slightly squeezing the container body. The use of a resilient container body enhances the control of the dispense by providing a sniff-back recapture of material from the lumen upon release of the squeezing pressure.

Other variations utilizing this invention will be apparent to those of ordinary skill in the art.

We claim as our invention:

1. A dispensing fluid hollow container and cap assembly comprising:

a) a container body having a neck with an opening to the body's interior at one end of a neck, the neck having external threads; b) an intermediate cap having first and second ends, the intermediate cap having a hollow large diameter portion skirt at a first end of the intermediate cap having internal threads engageable with the body neck threads whereby the cap is screwed to and carried by said container body, the intermediate cap having a dispensing channel open to said opening and to a second end of the intermediate cap remote from the skirt end, the channel closed by a pierceable membrane intermediate the first and second ends, the intermediate cap having a smaller diameter axial portion extending from the larger diameter portion to the second end, the smaller diameter portion having external threads; c) a nozzle cap having an internally threaded skirt at a first end carried by said intermediate cap by threaded attachment to exterior threads of the smaller diameter portion of the intermediate cap, the nozzle cap extending from the second end of the intermediate cap and having a lumen therethrough open to the channel adjacent the first nozzle cap end, the lumen terminating in a dispensing tip opening at a second nozzle cap end remote from the first nozzle cap end; d) an overcap received over the nozzle cap and threadably connected to the exterior of the nozzle cap; e) a piercing pin member carried by the overcap and positioned in said lumen when the overcap is threaded onto the nozzle cap and moveable therein to pierce an opening through a central portion of said membrane leaving the membrane attached to the intermediate cap, said pin removable from said membrane and said lumen after piercing by removing the outercap whereby after piercing the membrane, contents of the container body can be dispensed through the pierced membrane opening, through the lumen and from said remote dispensing tip opening, said pin being reinsertable in said lumen and into the pierced opening in the membrane without further substantially enlarging the opening by reattaching the overcap to the intermediate cap.

2. The assembly of claim 1 wherein the membrane is positioned in said channel closer to the first end than to the second end of the intermediate cap.

3. The container and cap assembly of claim 1 wherein the membrane is formed of a plastics material.

4. The assembly according to claim 3 wherein the intermediate cap and membrane are formed of plastics material and the membrane is molded in situ.

5. The assembly of claim 4 wherein the membrane has a central portion and an outer boundary and has a lesser thickness in the central portion thereof than at the outer boundary portion.

6. An assembly according to claim 4 wherein the second end of the intermediate cap is a distal end at which the nozzle cap is secured and the first end is a proximal end to which the container body is secured, the container body having a throat opening in communication with the dispensing channel, the dispensing channel having a proximal opening defined in a projecting boss at the first end, the boss dimensioned to be received in the throat opening in sealing peripheral engagement with surface portions at an interior of the throat opening.

7. An assembly according to claim 6 wherein the nozzle cap has first proximal and second distal ends, the distal end forming a dispensing tip at the second end, the first end having the lumen open therethrough, the lumen defined at the opening of the first end by a raised boss, the second end of the intermediate cap having a recess therein adapted to receive the raised boss of the nozzle cap, the boss of the nozzle cap being provided with a sealing surface sealingly engaging interior wall portions of the recess.

8. A dispensing container and cap assembly comprising: a hollow container body having a neck with an exterior and a throat opening open to an interior of the body, an intermediate cap having internal threads threaded to an exterior of said neck and having proximal and distal ends with a dispensing channel open to each end, the proximal end opening to said throat, a pierceable membrane closing said dispensing channel intermediate the proximal and distal ends the intermediate cap having external threads at the distal end, a nozzle cap having an elongated tapered dispensing central portion extending from a skirt portion having internal threads engaging the external threads of the intermediate cap axially spaced from the cap's internal threads, the central portion having a lumen therethrough, the nozzle cap when threaded to the intermediate cap carried by said intermediate cap with said lumen open to said channel, the lumen terminating at a distal end of the nozzle cap in a dispensing tip opening, an overcap threaded to an exterior nozzle cap and movably carrying a piercing member, the piercing member insertable through said lumen and moveable therein independent of movement of the overcap to pierce said membrane when the caps are threaded together, the piercing member being removable from said lumen and from said membrane after piercing by removal of the overcap from the nozzle cap, the piercing member dimensioned to pierce only a central portion of the membrane with the remaining portion of, the membrane remaining attached to the intermediate cap after piercing.

9. The assembly of claim 8 wherein mating frustoconical sealing surfaces are provided between the intermediate cap and the throat opening when the intermediate cap is fully threaded onto the body, the sealing surfaces providing a seal between an interior of the body and the exterior of the intermediate cap except through the dispensing channel.

10. The assembly of claim 9 wherein mating frustoconical sealing surfaces are provided between the intermediate cap and the nozzle cap when the nozzle cap is fully seated on the intermediate cap, the sealing surfaces providing a seal between the intermediate and nozzle caps except through the dispensing channel and lumen.

11. The assembly of claim 10 wherein the mating sealing surfaces are opposed male and female frusto conical surfaces with the male surface of a larger diameter creating an interference fit against the female surface.

* * * * *

UNITED STATES PATENT AND TRADEMARK OFFICE

CERTIFICATE OF CORRECTION

PATENT NO. : 7,677,413 B2
APPLICATION NO. : 11/454586
DATED : March 16, 2010
INVENTOR(S) : Rahim Usman and Dennis A. Gross It is certified that error appears in the above-identified patent and that said Letters Patent is hereby corrected as shown below:

Title Page, Item (73) Assignee: should be

-- (73) Assignee: Barristo, Ltd. --

Signed and Sealed this
Sixteenth Day of October, 2012

David J. Kappos

David J. Kappos
*Director of the United States Patent and Trademark Office*